US009644800B2

(12) United States Patent
Purdy

(10) Patent No.: US 9,644,800 B2
(45) Date of Patent: May 9, 2017

(54) LED LINEAR LAMP WITH UP AND DOWN ILLUMINATION

(71) Applicant: ELB ELECTRONICS, INC., Arcadia, CA (US)

(72) Inventor: Steven Purdy, Johns Creek, GA (US)

(73) Assignee: ELB ELECTRONICS, INC., Arcadia, CA (US)

( * ) Notice: Subject to any disclaimer, the term of this patent is extended or adjusted under 35 U.S.C. 154(b) by 0 days.

(21) Appl. No.: 14/727,771

(22) Filed: Jun. 1, 2015

(65) Prior Publication Data

US 2015/0345712 A1 Dec. 3, 2015

Related U.S. Application Data

(60) Provisional application No. 62/006,412, filed on Jun. 2, 2014.

(51) Int. Cl.

| | |
|---|---|
| ***F21K 9/27*** | (2016.01) |
| ***F21K 99/00*** | (2016.01) |
| *F21V 7/00* | (2006.01) |
| *F21Y 101/00* | (2016.01) |
| *F21Y 103/10* | (2016.01) |
| *F21Y 115/10* | (2016.01) |

(52) U.S. Cl.

CPC ..... *F21K 9/175* (2013.01); *F21K 9/27* (2016.08); *F21V 7/0016* (2013.01); *F21Y 2101/00* (2013.01); *F21Y 2103/10* (2016.08); *F21Y 2115/10* (2016.08)

(58) Field of Classification Search

CPC ..... F21Y 2101/02; F21Y 2103/003; F21Y 2113/005; F21Y 2111/005; F21Y 2103/022; F21Y 2105/001; F21Y 2111/001; F21Y 2113/00; F21Y 2103/00; F21Y 2105/003; F21Y 2105/008; F21Y 2111/002; F21Y 2111/007; F21Y 2113/02; F21Y 2103/10; F21Y 2115/10; F21Y 2101/00; F21K 9/175; F21K 9/27; F21V 7/0016

See application file for complete search history.

(56) References Cited

U.S. PATENT DOCUMENTS 6,659,622 B2 * 12/2003 Katogi ..... F21S 2/00 315/219
2008/0304250 A1 * 12/2008 Harbers ..... F21S 8/04 362/84

(Continued)

*Primary Examiner* — Anh Mai
*Assistant Examiner* — Fatima Farokhrooz
(74) *Attorney, Agent, or Firm* — Karish & Bjorgum, PC

(57) ABSTRACT

A LED linear lamp that eliminates the cave effect by transmits the majority of its light downwardly in a main illumination direction and a lesser amount of light upwardly in a secondary illumination direction that is in a direction opposite to the main illumination direction. The LED linear lamps of the invention have one or more circuit boards with LEDs positioned thereon. These circuit boards with LEDs are positioned in a light transparent or translucent tube. Down lighting in the main illumination direction is provided by having some LEDs facing downwardly in the primary illumination direction, while up lighting is provided by having some LEDs facing upwardly or by provision of light transmission holes in the circuit board to permit some light leakage upwardly.

7 Claims, 8 Drawing Sheets

(56) References Cited

U.S. PATENT DOCUMENTS

| | | | | |
|---|---|---|---|---|
| 2011/0141723 | A1* | 6/2011 | Lai | F21V 19/0045<br>362/218 |
| 2011/0192586 | A1* | 8/2011 | Fan | F21V 15/013<br>165/185 |
| 2011/0235318 | A1* | 9/2011 | Simon | F21K 9/17<br>362/217.05 |
| 2012/0212953 | A1* | 8/2012 | Bloom | H05B 33/089<br>362/223 |
| 2013/0230995 | A1* | 9/2013 | Ivey | F21K 9/175<br>439/226 |

* cited by examiner

LED LINEAR LAMP WITH UP AND DOWN ILLUMINATION

CROSS-REFERENCE TO RELATED APPLICATIONS

This application claims priority from U.S. Provisional Patent Application No. 62/006,412, entitled "LED LINEAR LAMP WITH UP AND DOWN ILLUMINATION", filed Jun. 2, 2014.

FIELD OF THE INVENTION

The invention relates to lighting and more particularly to LED linear lamps with designs that provide light projection even better than the fluorescent linear lamps the LED linear lamps are designed to replace.

BACKGROUND OF THE INVENTION

Fluorescent linear lamps generally have a circular cross section and have an emitted light output from their glass enclosure along their 360 degree radius about their longitudinal axis. They therefore provide light that radiates equally outwardly from their glass enclosure, which means that some of the light radiates directly out of open fluorescent fixtures in which they are mounted and some light is directed back into the fixture. Thus, when fluorescent linear lamps are installed in lighting fixtures, for example lighting fixtures that are suspended from or below a ceiling, the illumination is projected onto the ceiling in addition to downward toward the floor. In order to redirect some of this upwardly directed light downwardly where it is needed, most fluorescent linear lamp fixtures have, for example, a shiny mirrored or glossy white painted reflectors positioned above the fluorescent linear lamp. In many retail and commercial offices and warehouses that use high bay fluorescent fixtures or suspended fixtures, these fixtures have slots in the metal which allows a percentage of the illumination to exit the top of the fixture and illuminate the ceiling. Typically about 10% to 15% of the light is provided to up light.

While use of reflectors does help reflect some of the light back out, still some of the light is nonetheless absorbed and fails to be directed where it is needed for efficient illumination. This results in some of the light being wasted, which also represents a waste of electricity.

In contrast with fluorescent linear lamps, LED linear lamps typically provide illumination within about a 180 degree range of transmission. This is due to the fact that the individual light emitting diodes (LEDs) in the LED linear lamps are surface mounted on flat circuit boards located inside the center of a transparent or translucent tube. In some embodiments the flat circuit board is positioned near a center of the transparent or translucent tube, for example, as shown in FIG. 5, and light will exit the lower half of the transparent or translucent tube. In some other embodiments the flat circuit board is positioned nearer to one side of the transparent or translucent tube, for example as shown in FIG. 4, and light will exit through more than 180 degrees along the transparent or translucent walls of the transparent or translucent tube (in this embodiment about a 270 degree range.) Nonetheless, since the LEDs remain surface mounted to a flat circuit board positioned in the transparent or translucent tube, the light will still only project out along a 180 degree arc.

When a LED linear lamp is placed within a lighting fixture mounted on a ceiling with the LEDs directly downwardly, the light from the LEDs is projected downwardly toward the floor in a main illumination direction. Conversely, when a LED linear lamp is placed within a lighting fixture mounted below a ceiling with the LEDs directly upwardly to reflect on the ceiling, the emitted light is projected upward toward the ceiling. LED linear lamps do not have the capacity to simultaneously project in both the up and down directions. Therefore, unlike the case of hanging fluorescent linear lamp fixtures which direct some light up as well as down, when light is projected onto the floor using prior art LED linear lamps no light gets projected onto the ceiling, and the portion of the ceiling above the light fixture can remain somewhat dark. This is referred to as the "cave effect". Thus, if conventional LED linear lamps with their 180-270 degree of illumination are used, little or no light get projected onto the ceiling and this leads to the cave effect of dark ceiling with a lighted space below.

There accordingly remains a need for new designs of LED linear tube lamps that remain efficient and direct light where it is needed while not creating a cave effect.

SUMMARY OF THE INVENTION

The present invention provides LED linear lamps that provides both up and down illumination to provide illumination in more than a 270 degree range of illumination, and preferable in a 360 degree range of illumination but with certain sections of this range at a lower level of illumination to address the cave effect.

The LED linear lamps of the invention achieve up and down as well as side to side illumination by arranging LEDs in several arrangements, all having LEDs arranged on circuit board(s) in a transparent or translucent enclosure, such as a tube. The tube can be formed of material such as plastic or glass, and provides protection to the LEDs and the circuitry inside. At opposite ends of the tube are electrical contacts, with most LED linear lamps have two pins at each side, which are termed "bi-pin" lamps. The invention includes the following embodiments.

In one embodiment of the invention, LEDs are surface mounted to the upper surfaces of two circuit boards mounted back to back or adjacent to each other with some LEDs on the bottom facing surface in the direction of a primary or main illumination direction and some LEDs on the upwardly facing surface facing away from the main illumination direction, which is referred herein as the secondary illumination direction. In this embodiment, the light output of the circuit board facing the secondary illumination direction will preferably be set to about 10% to 15% of the light output of the light output of circuit board facing the main illumination direction.

In another embodiment of the invention, LEDs are surfaced mounted to the lower face of a main circuit board that is mounted near an upper end inside a main illumination tube, with the LEDs projecting downwardly in a main illumination direction. The main illumination tube is preferably flattened at its upper end along an interface region above the main circuit board to have a generally D-shaped profile. In order to provide for some upward illumination, a separate upper illumination unit is provided. The upper illumination unit will have its own circuit board with LEDs positioned to provide upper illumination in a direction opposite the main illumination direction of the main circuit board. The upper illumination unit will have power leads that electrically connect to the main circuit board. Other features can be used to physically connect the upper illumination unit to the main illumination unit. In this embodiment as well, the light output of upper illumination unit will preferably be set to about 10% to 15% of the light output in the main illumination unit.

In a further embodiment of the invention, there is a single double-sided circuit board with LEDs mounting on a downwardly facing surface in the main illumination direction and some LEDs mounted on an upwardly facing surface opposite the main illumination direction. In this embodiment, the light output from the upwardly facing surface of the circuit board will preferably be set to about 10% to 15% of the light output of the downwardly facing surface main illumination surface of the circuit board.

In a yet another embodiment of the invention LEDs are surfaced mounted to the lower surface of a circuit board with the LEDs directed in a main illumination direction. Further, light passage holes are formed to pass through the circuit board, which light passage holes permit some portion of the light generate by the LEDs to leak upwardly and provide upward light illumination. In this embodiment, the amount of light passing upwardly through the light passage holes will preferably be set to about 10% to 15% of the light output of the main illumination direct, which can be set by controlling the number, size, and positions of the light passage holes. To further enhance the amount of light projecting upwardly, light gathering lenses and/or optical fibers can be positioned in the light passage holes, which lenses and/or optical fibers will capture light from the illumination side of the circuit board and redirect some of the light upwardly so that preferably about 10% to 15% of the light outputted in the main illumination direction is directed upwardly above the top of the LED linear lamps so as to address the cave effect.

In all embodiments of the invention, use of the terms "up" or "upward" and "down" or "downward" refer to situations where the LED linear lamps are positioned in fixtures such that the primary or main illumination direction is directed downwardly to the floor and the secondary illumination direction is pointed upwardly at the ceiling to deal with the cave effect. The number, spacing, and/or intensities of the LEDs on the circuit board(s) can be adjusted to create the desired lighting patterns. Furthermore, if desired, LEDs with different colors and/or color temperatures can be used to project upwardly and downwardly.

While conventional flat circuit boards can be used in all embodiments noted above, flexible or curved circuit boards having the LEDs mounted on a convex side of the circuit board will allow light from the LEDs to be projected at an angular range greater than 180 degrees. This is because edge regions of the circuit board will be set back further from the level of the LEDs, and will thus block the light less than in the case of flat circuit boards.

Conventional fluorescent lamp tubes are filled with a gas containing low pressure mercury vapor and argon, xenon, neon, or krypton, and thus the tubes are provided with a circular cross section for maximum strength while maintaining minimum wall thickness. In contrast, since there is no gas in a LED linear lamps, the enclosures used with the embodiments of the invention noted herein need not have a circular cross section. The enclosure or tube of the LED linear lamps of the invention may be selected to have a circular cross section so that they can fit into conventional fluorescent tube lamp fixtures and have a generally similar appearance as conventional fluorescent tube lamp. However, the tube may also have non-circular cross-sectional shapes, and in particular those sections of the tube that are not visible from below the LED linear tube lamps can be non-rounded, as in the case of the embodiment described above.

Another point with respect to all embodiments of the invention is that while reference is made to the LEDs being surface mounted, the LEDs can in fact be mounted in other manners so long as their light projects above the surface(s) of the circuit board(s).

Yet another point is that while the term "LED linear lamps" is used in connection with the various embodiments described herein, the LED linear lamps of the invention need not be of the variety that are completely straight. Indeed, these lamps can follow circular paths (such as for use in circular light fixtures), can be U-shaped or can include U-shaped turned sections, or can have other non-straight shapes.

These and other features of the invention are described below.

DETAILED DESCRIPTION

Figure 1:
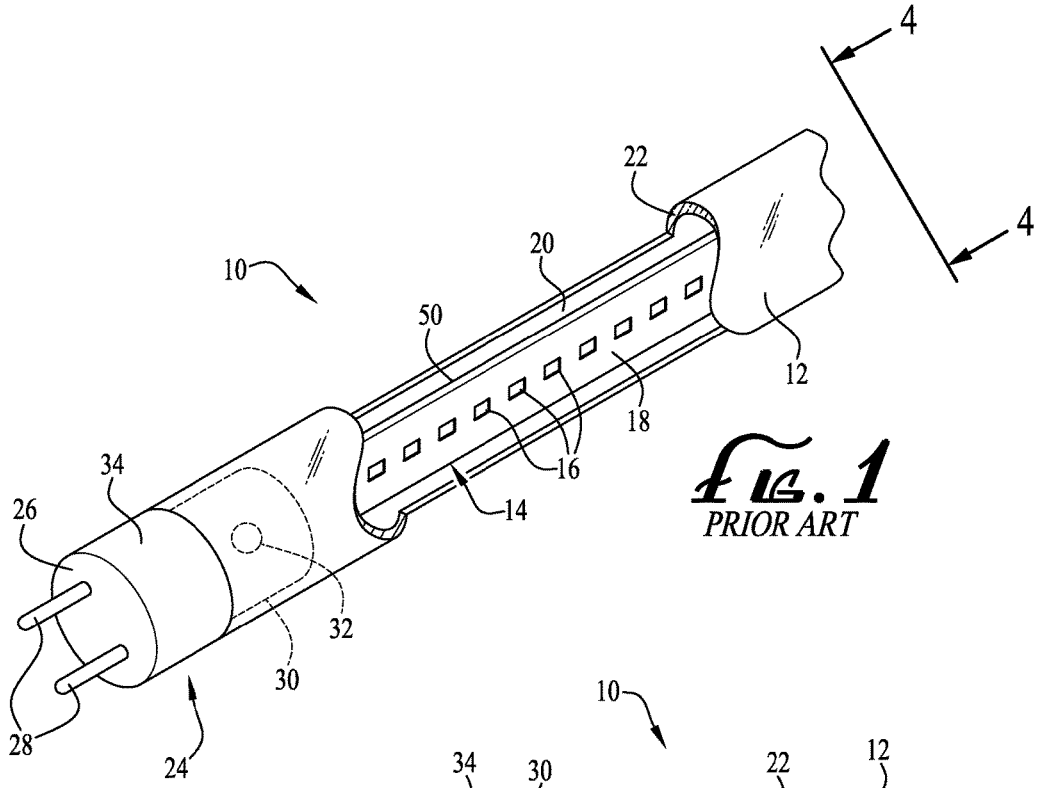
FIG. 1 PRIOR ART
FIG. 1 is a partially exposed isometric view of a section of a prior art LED linear lamp.
Figure 2:
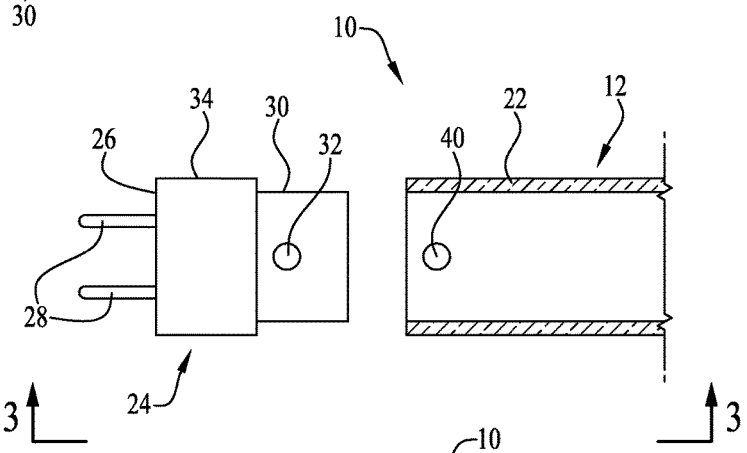
FIG. 2 PRIOR ART
FIG. 2 is a detailed view showing construction of a prior art LED linear lamp and its connector end.
Figure 3:
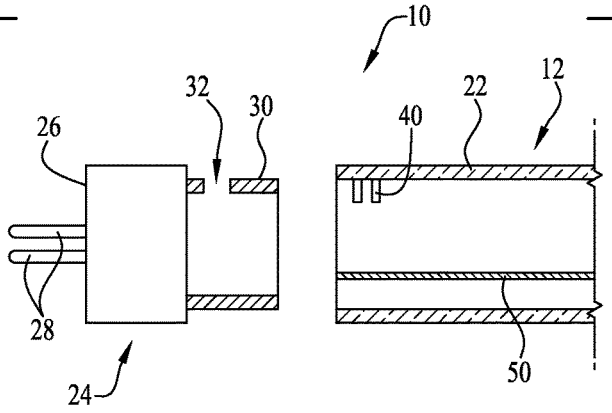
FIG. 3 PRIOR ART
FIG. 3 is cross-sectional view along view lines 3-3 of FIG. 2

Turning first to FIG. 1, there is shown a partially exposed isometric view of a prior art LED linear lamp 10, while FIG. 2 is a detailed view showing construction of a LED linear lamp and its connector end with FIG. 3 being a cross-sectional view along view lines 3-3 of FIG. 2. The lamp has a transparent or translucent tube 12 such as formed of plastic, and has a circuit board 14 with a plurality of LEDs 16 fixed to the top thereof to extend above an upper surface 18 of the circuit board 14. The transparent or translucent tube 12 has a wall 22 with desired thickness. Circuit board retainers 50 can be molded onto inside wall of the tube 22 which retainers 50 will hold the circuit board 14 in place in the tube 12. Connector ends 24 engage with ends of the tube 12. The connector ends 24 have a terminal face 26 with extending contacts 28. The LED linear lamp 10 shown has two leads on the connector ends 24 and is of the so-called bi-pin design. Other designs are available including single pin lamps. Connector ends 24 each have a cylindrical sleeve region 34 and a smaller diameter seat region 30 with a catch hole 32 formed therein. The tube 12 has an inwardly protruding button 40 near its ends. When the tube 12 is slide over the seat regions 30, the protruding buttons 40 on the tube 12 will snap into the catch holes 32 of the seat regions 30 and permanently retain the connector ends 24 on the ends of the tube. The circuit board 14 and its LEDs 16 are electrically connected to the leads 28. Other designs can be used to retain the circuit board in place and retain the connector ends in place, including adhesives, sonic welding, and mechanical connectors, to name a few.

Figure 4:
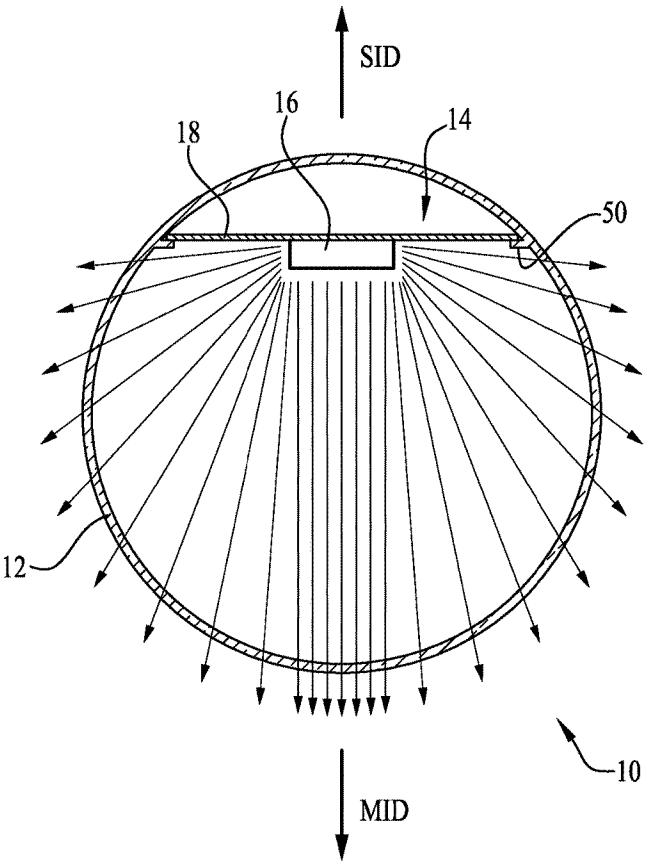
Fig. 4 PRIOR ART
FIG. 4 is a cross-sectional view along view lines 4-4 of FIG. 1 showing the arrangement of the circuit board and LED in a tube of a prior art LED linear lamp.

FIG. 4 is a cross-sectional view along view lines 4-4 of FIG. 1 showing the arrangement of the circuit board 14 and LEDs 16 in the tube 12 of the prior art LED linear lamp shown in FIGS. 1-3. Light from the LEDs is projected in a main illumination direction (MID). On the other side of the circuit board 14 opposite the LEDs 16, there is the secondary illumination direction (SID). As is shown, even with the circuit board 18 being spaced closer to the top of the tube 12 so that light projects out along a great range through the tube 14, about 270 degrees, light is still blocked from being projected along the secondary illumination direction SID and will not project out upwardly beyond the level of the circuit board.

Figure 5:
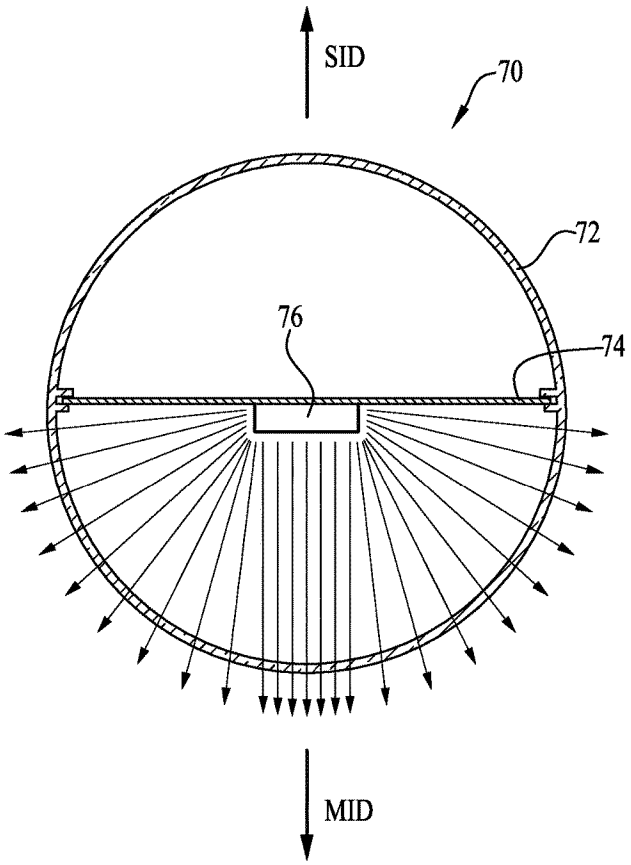
Fig. 5 PRIOR ART
FIG. 5 is a cross-sectional view showing the arrangement of the circuit board and LED in a tube of another prior art LED linear lamp.

FIG. 5 is a cross-sectional view showing the arrangement of a circuit board 74 and LEDs 76 in a tube 72 of another prior art LED linear lamp 70. In this embodiment, the circuit board 74 is located approximately in the middle of the tube 72, and as compared to the LED linear lamp 10 of FIG. 4, light will project out only along about the bottom half of the tube 72 along about a 180 degree range.

Figure 6:
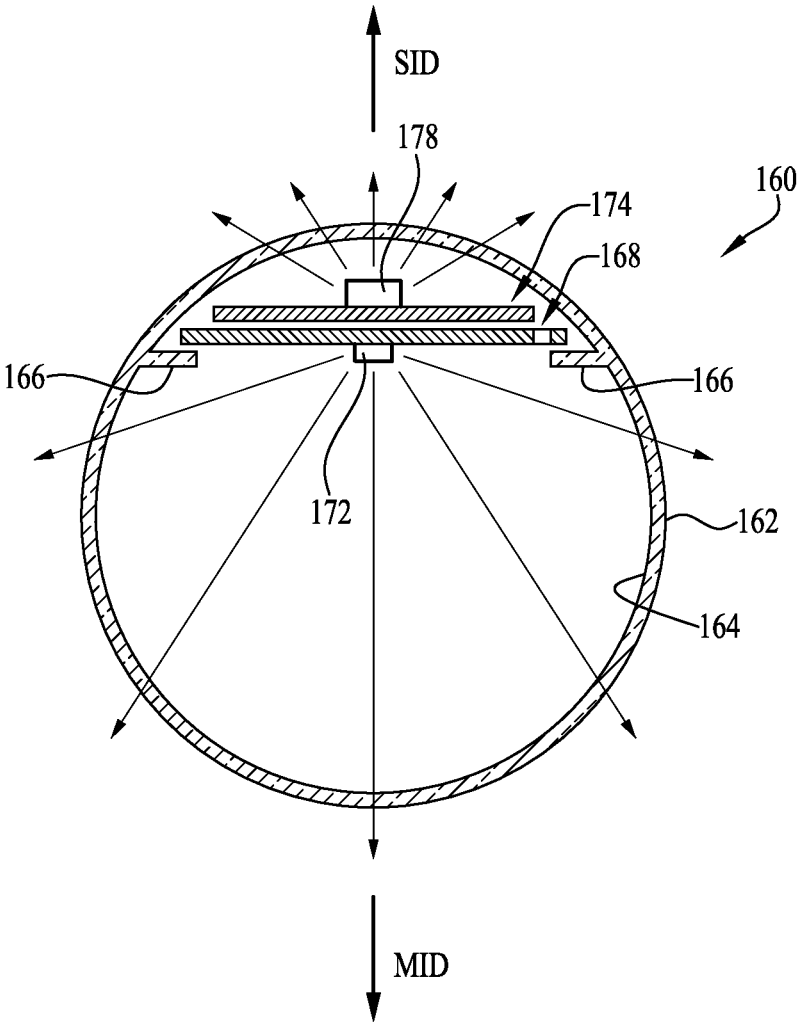
FIG. 6 is a cross-sectional view showing an embodiment of a LED linear lamp of the invention that has an arrangement of two back to back circuit boards each with their own LEDs in a tube.

FIG. 6 is a cross-sectional view showing an embodiment of a LED linear lamp 160 of the invention that has an arrangement of two back to back circuit boards 168 and 174, each with their own LEDs 172 and 178, respectively, with the LEDs 172 directed in a main illumination direction MID and with the LEDs 178 pointed in a secondary illumination direction SID. To clarify, while there is a main illumination direction, light will also be projected to the sides and outwardly to the extent not blocked by the circuit board and internal structures of the LED linear lamp. Indeed, each LED has certain characteristics including the angular range of lighting, with some LEDs delivering highly focused light in a narrow angular range or cone, while other LEDs delivery light in a wider range or cone. Moreover, the separate LEDs can be mounted at various angles relative to the circuit board to provide for a greater range of light distribution. As previously noted, LEDs are available in different colors and color temperatures. For example, 2700 K LED lamps are considered warm white while 5000 K lamps are considered "daylight" color. These points apply not only to this embodiment, but other embodiments described herein. The circuit boards and LEDs are positioned inside a transparent or translucent tube 162. Retention beads 166 extending from an inside surface 164 of the tube 162 retain the circuit boards 168 and 174 in place. In this embodiment of the LED linear lamp 160, the light output of the circuit board 174 facing the secondary illumination direction SID will preferably be set to about 10% to 15% of the light output of the circuit board 168 directed to the main illumination direction MID. For this embodiment as well as other embodiments of the invention, use of the terms up or upward and down or downward in this application refers to situations wherein LED linear tube lamps are positioned in fixtures such that the primary or main illumination direction is directed downwardly to the floor and the secondary illumination direction is pointed upwardly at the ceiling to deal with the cave effect. Furthermore, the numbers, spacing, and/or intensities of LEDs on the circuit board can be adjusted to create the desired lighting pattern of projecting about 10% to 15% of the light upwardly.

Figure 7:
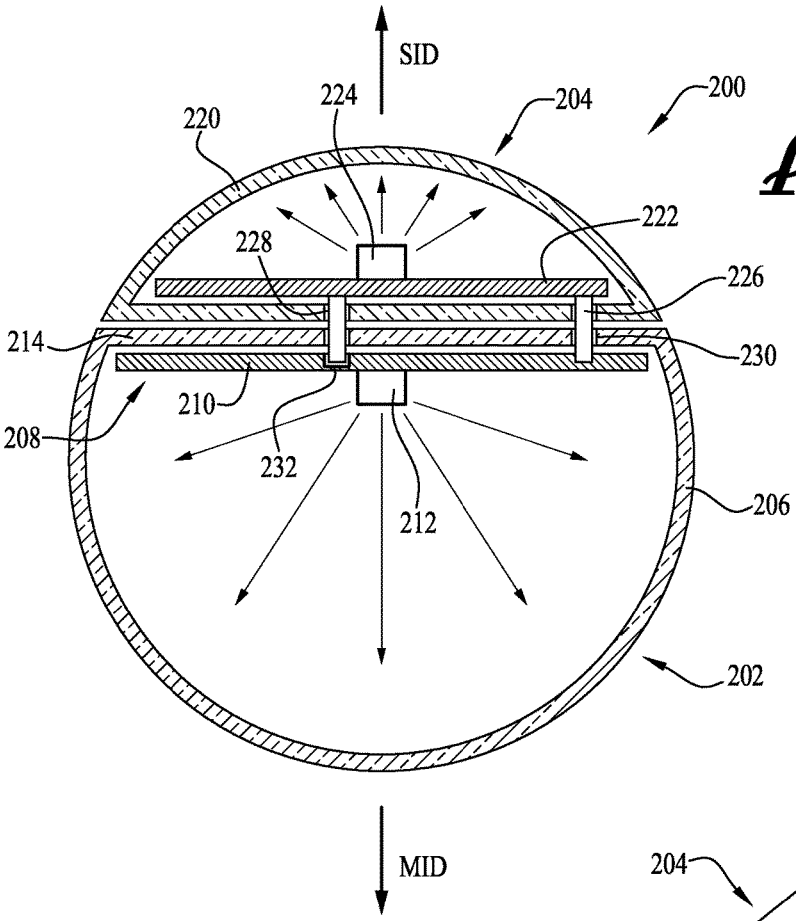
FIG. 7 is a cross-sectional view showing another embodiment of a LED linear lamp of the invention, having a main illumination with a D-shaped tube with an internally mounted circuit board with LEDs directed in a main illumination direction, and an accessory illumination unit with its own circuit board and LEDs that face in a secondary illumination direction, with the accessory illumination unit detachably electrically connected to top of the main illumination tube.
Figure 8:
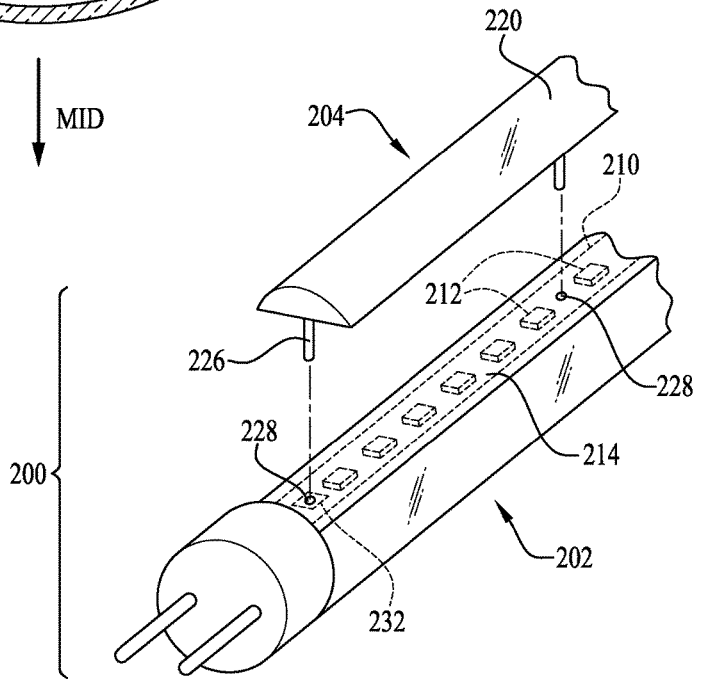
FIG. 8 is an exploded isometric view showing the embodiment of the LED linear lamp of FIG. 7.
Figure 9:
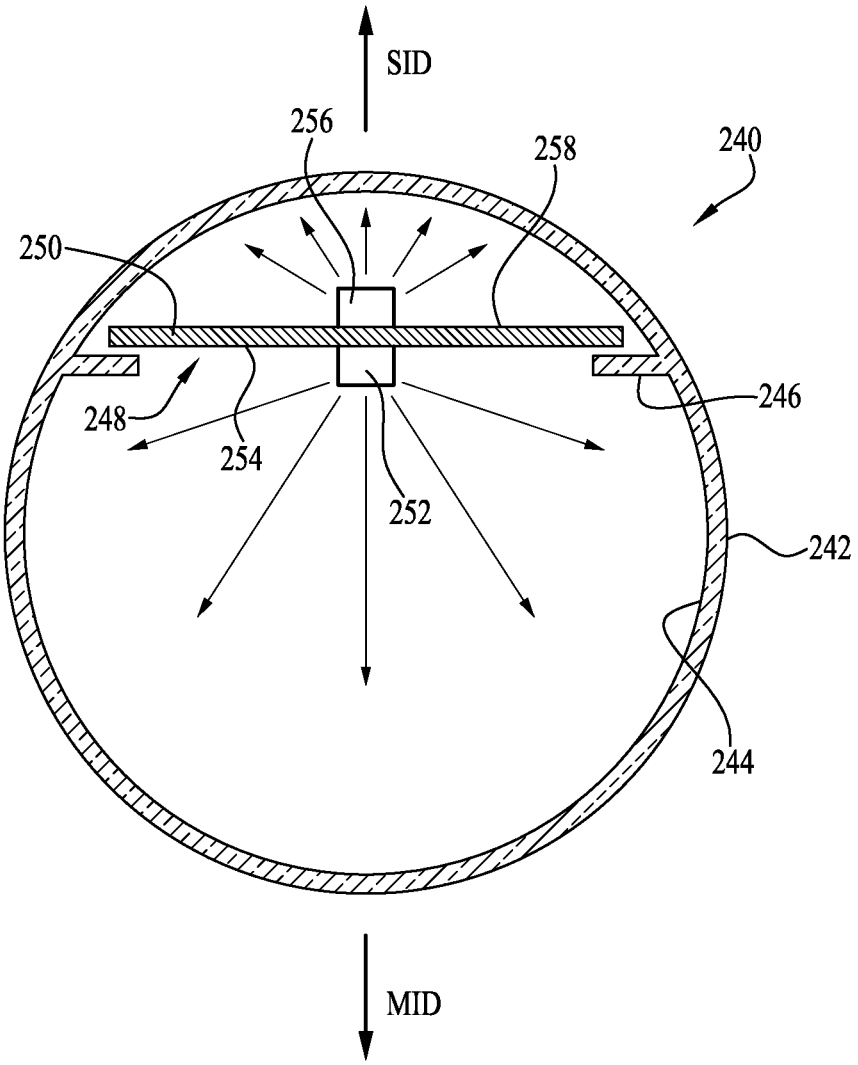
FIG. 9 is a cross-sectional view showing an embodiment of a further LED linear lamp of the invention that has an arrangement of a single circuit board with LEDs mounted on the upper and lower surfaces of the circuit board in a tube.

FIG. 7 is a cross-sectional view showing another embodiment of a LED linear lamp 200 of the invention, having a main illumination unit 202 with a D-shaped tube 206 with an internally mounted circuit board 208 with electrical supply contacts 232. Apertures 228 are formed in D-shaped tube 206 above the electrical supply contacts 232. LEDs 212 mounted to a bottom surface 210 thereof directed in a main illumination direction MID, and an secondary illumination unit 204 with its own circuit board 222 and LEDs 224 that face in a secondary illumination direction SID, with the secondary illumination unit 204 detachably electrically connected to flat top 214 of the main illumination unit 202. The secondary circuit board 222 fits inside the space of the secondary illumination unit 204. The secondary illumination unit 204 can connected to the main illumination unit 202 by electrical connectors 226 that extend downwardly and pass through apertures 228 in the flat top 214 of the main illumination tube 202 and into the electrical supply contacts 232. Alternately, the electrical connectors 226 of the secondary illumination unit can be positioned at ends thereof and be oriented to pass through end caps 234 which would carry the electrical supply contacts 232. Other arrangements of the electrical connectors 226 and the electrical supply contacts 232 are possible and the invention is not limited to only one arrangement. FIG. 8 is an exploded isometric view of the LED linear lamp 200 of FIG. 7. When the accessory illumination unit 204 is connected to the main illumination unit 202 the desired additional upward illumination can be provided as desired. However, in cases where LED linear lamps 200 will be mounted in a fixture that do not require upward illumination, accessory illumination unit 204 need not be used. While the by electrical connectors 226 are shown as extending through the bottom of the secondary illumination unit from the secondary circuit board and passing through apertures in the interface region of the main illumination unit and into electrical contact FIG. 9 is a cross-sectional view showing an embodiment of a further LED linear lamp 240 of the invention that has an arrangement of a single circuit board 250 with an lower surface 248 and an upper surface 258, with some LEDs 252 mounted on the lower surface 254 and some LEDs 256 mounted to the upper surface of the circuit board 250. The circuit board 250 and LEDs 252 are maintained in position by use of beads 246 extending from inside surfaces 244 of the tube 242. Again, as with other embodiments of the invention, the light output in the secondary illumination direction SID will preferably be set to about 10% to 15% of the light output in the main illumination direction MID.

Figure 10:
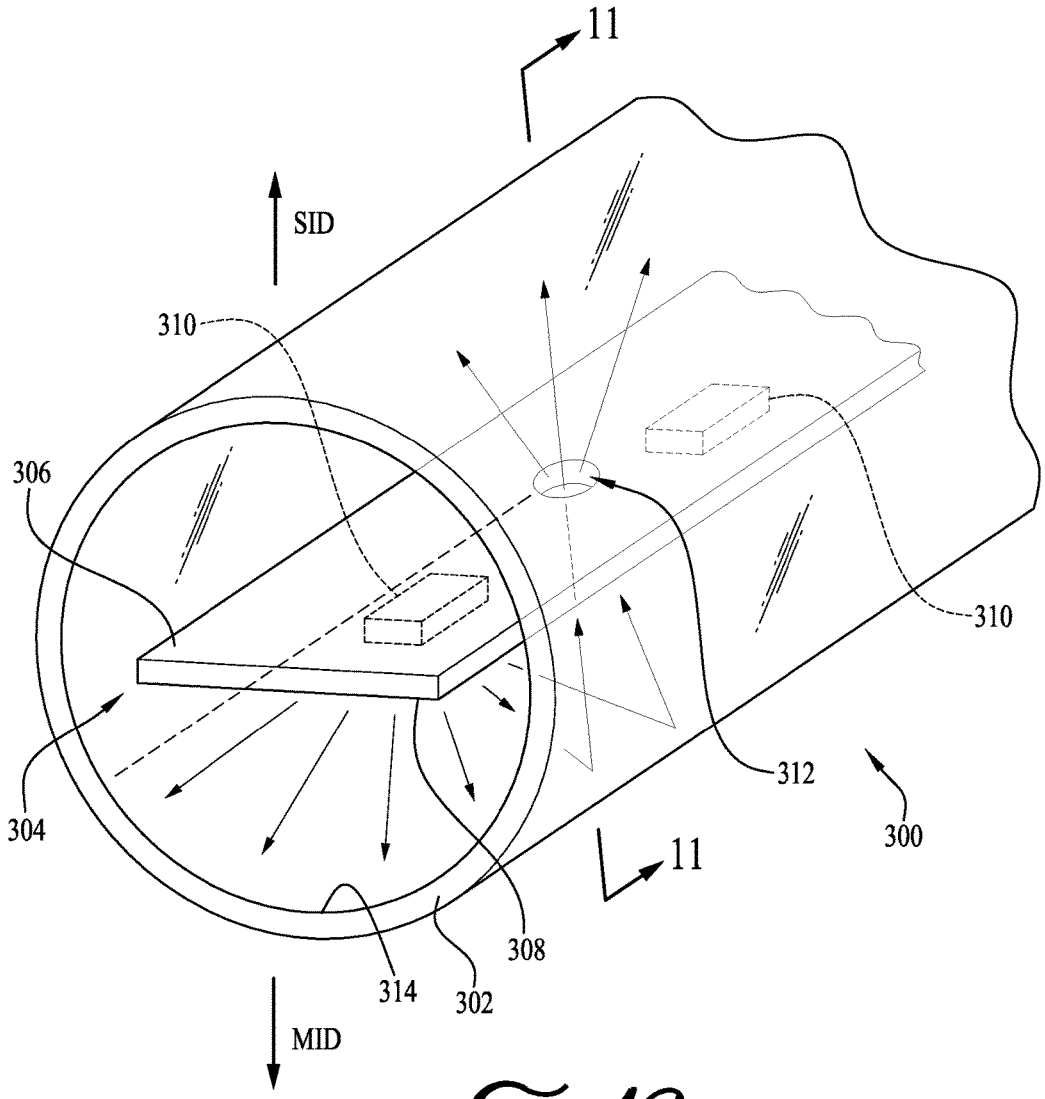
FIG. 10 is a partially exposed isometric view showing an embodiment of a yet a further LED linear lamp of the invention that has an arrangement of a single circuit board with LEDs in a tube, with the LEDs mounted on the lower surface of the circuit board to project light in a main illumination direction and with light passage holes formed through the circuit board to allow for passage of some light in a secondary illumination direction.
Figure 11:
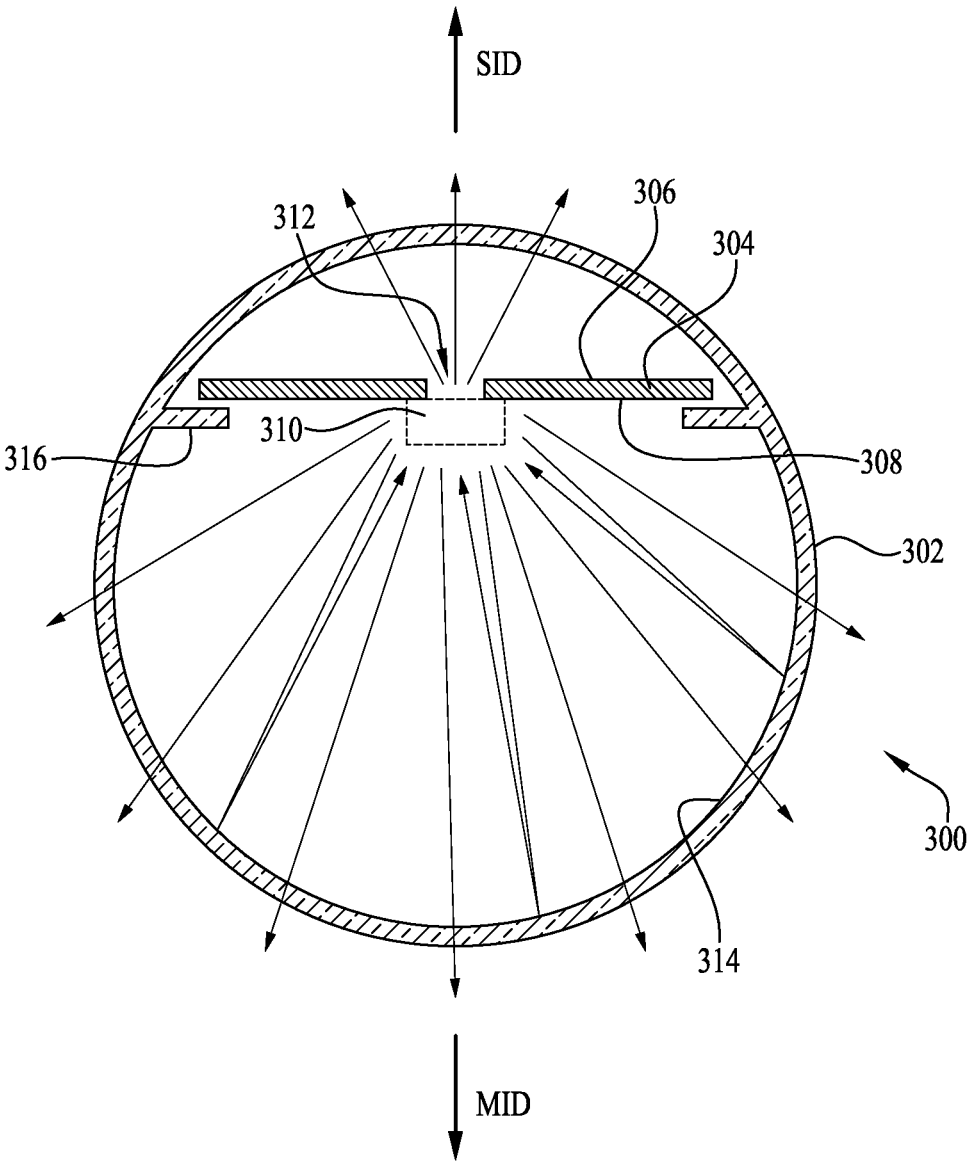
FIG. 11 is a cross-sectional view through view lines 11-11 of FIG. 10 and show how light is directed upwardly through the light passage holes.

FIG. 10 is a partially exposed isometric view and FIG. 11 is a cross-sectional view showing an embodiment of yet a further LED linear lamp 300 of the invention that has an arrangement of a single circuit board 304 with LEDs 310 mounted to extend a lower surface 308 thereof so that light from the LEDs will be generally projected in a main illumination direction MID. The single circuit board 304 with LEDs 310 is mounted in a tube 302. Holes 312 are formed in the circuit board 304 that pass from the top 306 to the bottom 308. These holes 312 allow for the passage of some light from below the circuit board with the LEDs which is partially reflected back up through the holes 312 by reflecting from the walls 314 of the tube 302. The shape, size, location, and density of holes can be adjusted to provide for the appropriate amount of light that will leak upwardly in the secondary illumination direction SID, which amount can preferably be set to be about 10% to 15% of the amount of light projected in the main illumination direction MID. One advantage of this embodiment is that no additional electronics are required to provide for the upwardly lighting.

Figure 12:
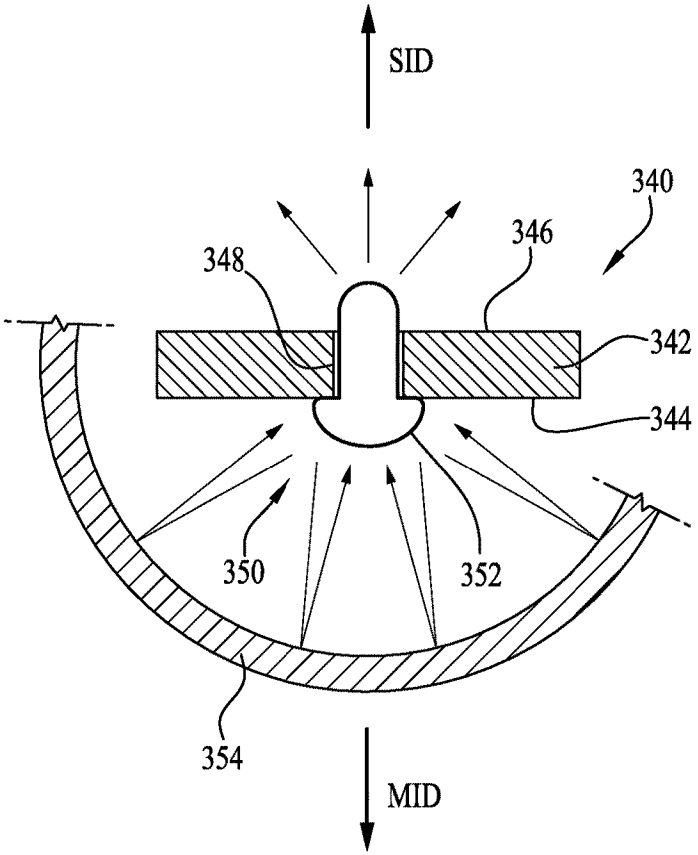
FIG. 12 is a detail view showing another embodiment of a LED linear lamp of the invention that has an arrangement of a single circuit board with LEDs in a tube, with the LEDs mounted on the lower surface of the circuit board to project light in a main illumination direction and with light passage holes formed through the circuit board with a lens located therein, which lens transmits some light from the LEDs upwardly in the secondary illumination direction.

FIG. 12 is a detail view showing another embodiment of a LED linear lamp 340 of the invention that has an arrangement of a single circuit board 342 with LEDs 352 mounted below a lower surface 344 thereof. The circuit board 342 has holes 348 formed therein that pass from the lower surface 344 to the upper surface 326 like in the embodiment of the LED linear lamp 300 shown in FIGS. 10 and 11, except that in the current embodiment of the LED linear lamp 340, a lenses or optical fibers 350 are located in the holes 348, which lenses or optical fibers will more efficiently transmit light from below the circuit board and transmit it in the secondary illumination direction SID. This occurs when light from the LEDs 352 bounce off the tube 354 and is directed through the lenses or optical fibers 350. Indeed, if lenses are used, they can more efficient collect light than use of holes alone.

Figure 13:
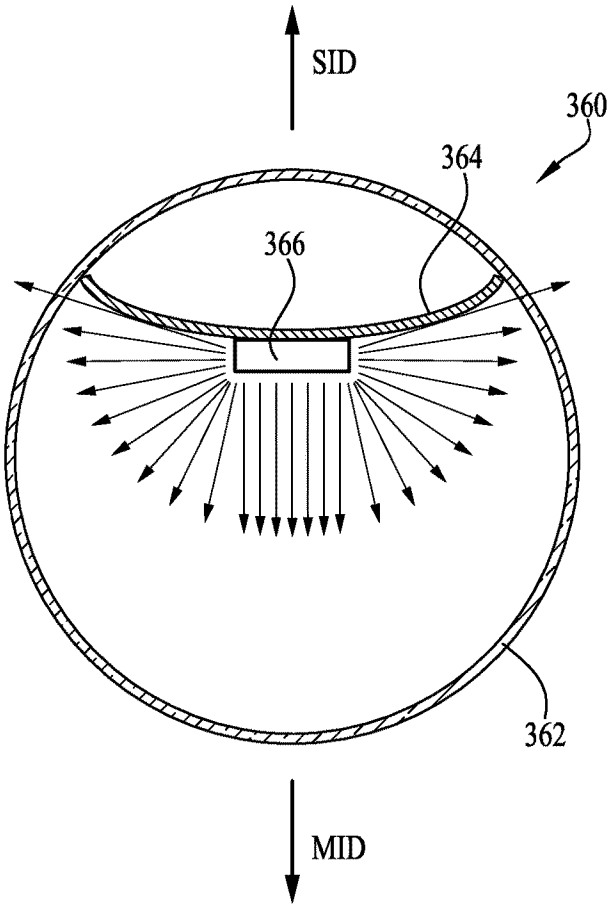
FIG. 13 is a cross-sectional view showing the arrangement of a curved circuit board and LEDs in a tube to illustrate how a curved circuit board permits a great range of light disbursement compared to a flat circuit board.

FIG. 13 is a cross-sectional view showing yet another embodiment of a LED linear tube 360 that is similar to the prior art arrangement of FIG. 4, but instead of having a flat circuit board, has a curved circuit board 364 with LEDs 366 mounted to the bottom thereof. The circuit boards and its LEDs are positioned and retained in a tube 362. FIG. 13 illustrates how a curved circuit board 364 permits a great range of light disbursement compared to a flat circuit board since edges of the board away from the LEDs are curved backwardly. In any of the embodiments of the invention, curved circuit board(s) could be used to distribute light over a wider range than might be possible with flat circuit boards.

The end connectors on each of the embodiments described above can be connected to the ends of the tube in the same manner as noted with respect to the prior art LED linear tubes described in FIGS. 1-3, or by the use of other mechanical technical. It is also possible to join the end connectors to the tube by adhesive, sonic welding, or other known techniques.

For the various embodiments of the invention described herein, use of the terms up or upward and down or downward in this application refers to situations wherein LED linear tube lamps are positioned in fixtures such that the primary or main illumination direction is directed downwardly to the floor and the secondary illumination direction is pointed upwardly at the ceiling to deal with the cave effect. Furthermore, the numbers, spacing, and/or intensities of LEDs on the circuit board can be adjusted to create the desired lighting pattern of projecting about 10% to 15% of the light upwardly. Also, too clarify, while there is a main illumination direction, light will also be projected outwardly and to the extent not blocked by the circuit board and internal structures of the LED linear lamp. It is also noted that each LED has certain characteristics including the angular range of lighting, with some LEDs delivering highly focused light in a narrow angular range or cone, while other LEDs delivery light in a wider range or cone. Moreover, the separate LEDs can be mounted at various angles relative to the circuit board to provide for a greater range of light distribution.

The preferred embodiments of this invention have been disclosed, however, so that one of ordinary skill in the art would recognize that certain modifications would come within the scope of this invention.

What is claimed is:

1. A LED linear lamp comprising:

a main illumination unit having a main illumination circuit board having an upper surface and a lower surface, a plurality of LEDs mounted to the main illumination circuit board to project light below the lower surface in a main illumination direction, electrical supply contacts, a transparent or translucent main tube with two opposite ends and having an upper interface region along a top of the main tube, connector ends positioned on the ends of the tube, the connector ends having electrical power leads, wherein the main illumination circuit board with LEDs is positioned inside the main tube with the main illumination direction being directed downwardly, and a secondary illumination unit having a secondary illumination circuit board with an upper surface and a lower surface, a plurality of LEDs mounted to the secondary illumination circuit board to project light above the upper surface in a secondary illumination direction that is generally opposite the main illumination direction, a transparent or translucent secondary tube having a lower interface region, and electrical supply connectors;

wherein the lower interface region of the secondary illumination unit engages the upper interface region of the main tube and wherein the electrical supply connectors of the secondary illumination unit electrically engaging with the electrical supply contacts of the main illumination unit, with the main illumination unit providing illumination in the main illumination direction and with the secondary illumination unit providing illumination in the secondary illumination direction.

2. The LED linear lamp of claim 1, wherein the electrical supply contacts are positioned in the main illumination circuit board and wherein the electrical supply connectors extend from the secondary circuit board and through the lower interface region of the secondary tube.

3. The LED linear lamp of claim 1, wherein the secondary illumination circuit board in positioned with its upper surface adjacent to the upper interface region of the main tube and wherein the secondary illumination circuit board with LEDs is positioned inside the secondary tube adjacent to the lower interface region.

4. The LED linear lamp of claim 1, wherein main tube has a generally D-shaped cross-section with a flat part of the D corresponding to the upper interface region, and wherein the secondary tube has a curved upper face and a flat lower face which flat lower face corresponds to the lower interface region.

5. The LED linear lamp of claim 1, wherein the tube is straight.

6. The LED linear lamp of claim 1, wherein light output in the secondary illumination direction is about 10% to 15% of the light output in the main illumination direction.

7. The LED linear lamp of claim 1, wherein one or both of the primary illumination circuit board and secondary illumination circuit boards are convexly curved in the primary illumination direction and the secondary illumination direction, respectively.

* * * * *